US008739411B2

(12) United States Patent
Kinghorn et al.

(10) Patent No.: US 8,739,411 B2
(45) Date of Patent: Jun. 3, 2014

(54) BACK HAIR REMOVAL USING COMB AND INTEGRATED BLADE

(75) Inventors: Iain Kinghorn, Chicago, IL (US); Matthew J Dryfhout, Orland Park, IL (US)

(73) Assignees: Matt Dryfhout, Orland Park, IL (US); Iain Kinghorn, Orland Park, IL (US)

( * ) Notice: Subject to any disclaimer, the term of this patent is extended or adjusted under 35 U.S.C. 154(b) by 451 days.

(21) Appl. No.: 12/284,550

(22) Filed: Sep. 22, 2008

(65) Prior Publication Data

US 2010/0071214 A1 Mar. 25, 2010

(51) Int. Cl.
*B26B 21/12* (2006.01)

(52) U.S. Cl.
USPC ..... 30/30; 30/50; 30/526

(58) Field of Classification Search
USPC ..... 30/50–84, 526, 532, 534, 47, 30, 31; D28/52; 132/213.1
See application file for complete search history.

(56) References Cited

U.S. PATENT DOCUMENTS

| | | | | | |
|---|---|---|---|---|---|
| 65,130 | A | * | 5/1867 | Spelman | 30/30 |
| 1,288,522 | A | * | 12/1918 | Cowan | 30/31 |
| 1,419,187 | A | * | 6/1922 | Wilson | 30/31 |
| 1,477,689 | A | * | 12/1923 | Burns | 30/31 |
| 1,789,234 | A | * | 1/1931 | Keenan | 30/30 |
| 1,899,414 | A | * | 2/1933 | Gray | 30/30 |
| 2,165,391 | A | * | 7/1939 | Lewis | D28/52 |
| 2,171,880 | A | * | 9/1939 | Lewis | 30/31 |
| D123,180 | S | * | 10/1940 | Pileggi | D28/52 |
| 2,234,440 | A | * | 3/1941 | Lewis | 30/30 |
| 2,237,676 | A | * | 4/1941 | Lewis | 30/30 |
| 2,252,628 | A | * | 8/1941 | Grachan | 30/30 |
| 2,256,326 | A | * | 9/1941 | Quinio | 30/30 |
| D150,189 | S | * | 7/1948 | Zurlinden | D28/52 |
| D154,784 | S | * | 8/1949 | Lazar | D28/25 |
| 2,488,436 | A | * | 11/1949 | Santoro, Sr. | 30/30 |
| D157,063 | S | * | 1/1950 | Mansfield | D28/52 |
| D157,064 | S | * | 1/1950 | Mansfield | D28/52 |
| D159,994 | S | * | 9/1950 | Lee | D28/52 |
| D161,784 | S | * | 1/1951 | Palmer | D28/52 |

(Continued)

FOREIGN PATENT DOCUMENTS

JP A-2004-236766 8/2004

OTHER PUBLICATIONS iShave from www.ishave.com.biz downloaded Jun. 24, 2007.

(Continued)

*Primary Examiner* — Jason Daniel Prone
(74) *Attorney, Agent, or Firm* — Matthew Dryfhout; Iain Kinghorn

(57) ABSTRACT

A method and apparatus of removing hair from the back, shoulders and arms of a man utilizes a device comprising a comb having teeth on a lower end and a blade embedded in the teeth so that a lower active edge of the blade does not reach a lower edge of the teeth and a s result there is no exposed blade and no skin irritation or safety concerns. A rigid or semi-rigid one-piece elongated handle, a proximal end of the handle having a channel shaped to slidably receive the upper end of the comb, the proximal end also having a lever pressing against the comb to hold the comb securely to the proximal end of the handle, the lever capable of being bent to release the comb. The device has a center of gravity approximately one-third of the way down the handle from the proximal end of the handle.

11 Claims, 8 Drawing Sheets

(56) References Cited

U.S. PATENT DOCUMENTS

| | | | | | |
|---|---|---|---|---|---|
| 2,568,368 | A | * | 9/1951 | Sayer et al. | 30/30 |
| 2,587,964 | A | * | 3/1952 | Burns | 30/30 |
| RE23,505 | E | * | 5/1952 | Davis | 30/31 |
| 2,615,243 | A | * | 10/1952 | Brown | 30/30 |
| 2,633,635 | A | * | 4/1953 | North | 30/30 |
| 2,641,055 | A | * | 6/1953 | Mansfield | 30/30 |
| 2,661,529 | A | * | 12/1953 | Infantino | 30/30 |
| 2,663,930 | A | * | 12/1953 | Di Zazzo | 30/31 |
| 2,670,533 | A | * | 3/1954 | Kearney | 30/31 |
| 2,725,886 | A | * | 12/1955 | Gagliano | 30/30 |
| 2,746,144 | A | * | 5/1956 | Spanel | 30/31 |
| 2,858,835 | A | * | 11/1958 | Parziale | 132/213.1 |
| 2,869,229 | A | * | 1/1959 | Hightower | 30/30 |
| 2,896,320 | A | * | 7/1959 | Caplan | 30/30 |
| 2,967,354 | A | * | 1/1961 | Ahlborn | 30/30 |
| 2,972,187 | A | * | 2/1961 | Gore | 30/30 |
| D190,580 | S | * | 6/1961 | Christensen | D28/52 |
| 3,041,721 | A | * | 7/1962 | Quinio, Sr. | 30/30 |
| D195,954 | S | * | 8/1963 | Christensen | D28/52 |
| D197,588 | S | * | 2/1964 | Macon | D28/52 |
| 3,238,616 | A | * | 3/1966 | Eweson | 30/30 |
| D205,453 | S | * | 8/1966 | Christensen | D28/52 |
| 3,358,367 | A | * | 12/1967 | Bartley | 30/30 |
| D211,443 | S | * | 6/1968 | Tin | D28/52 |
| 3,413,720 | A | * | 12/1968 | Mullen | 30/62 |
| D219,501 | S | * | 12/1970 | Trevor | D28/52 |
| 3,570,121 | A | * | 3/1971 | Graceffo | 30/30 |
| 3,599,327 | A | * | 8/1971 | Calandra | 30/30 |
| 3,644,992 | A | * | 2/1972 | Bennett et al. | 30/64 |
| 3,675,323 | A | * | 7/1972 | Braginetz | 30/75 |
| 3,816,912 | A | * | 6/1974 | Glaberson | 30/63 |
| 3,816,913 | A | * | 6/1974 | Ferraro | 30/63 |
| D232,874 | S | * | 9/1974 | Koblick | D28/52 |
| 3,986,258 | A | * | 10/1976 | Liedtke | 30/30 |
| 4,009,517 | A | * | 3/1977 | Horn | 30/30 |
| 4,011,656 | A | * | 3/1977 | Liedtke | 30/30 |
| 4,020,549 | A | | 5/1977 | Edwards | |
| 4,069,580 | A | * | 1/1978 | Cartwright et al. | 30/50 |
| 4,094,066 | A | * | 6/1978 | Daniel, Jr. | 30/77 |
| 4,163,316 | A | * | 8/1979 | Hagmann et al. | 30/532 |
| 4,198,746 | A | * | 4/1980 | Trotta | 30/532 |
| RE30,913 | E | * | 4/1982 | Cartwright et al. | 30/50 |
| 4,344,226 | A | * | 8/1982 | Blake, III | 30/55 |
| 4,346,721 | A | | 8/1982 | Molaro | |
| 4,409,735 | A | * | 10/1983 | Cartwright et al. | 30/77 |
| 4,446,619 | A | * | 5/1984 | Jacobson | 30/526 |
| 4,599,793 | A | * | 7/1986 | Iten | 30/532 |
| 4,663,841 | A | * | 5/1987 | Custer | 30/30 |
| 4,905,372 | A | | 3/1990 | Willis | |
| 4,912,846 | A | * | 4/1990 | Yu | 30/81 |
| D312,144 | S | * | 11/1990 | Buba | D28/52 |
| 5,220,728 | A | * | 6/1993 | Ueno et al. | 30/30 |
| 5,299,104 | A | * | 3/1994 | Parmentier | 30/34.05 |
| 5,386,750 | A | * | 2/1995 | Morrison | 30/31 |
| 5,388,332 | A | * | 2/1995 | Oldroyd | 30/50 |
| 5,410,810 | A | * | 5/1995 | Gillibrand | 30/84 |
| D364,939 | S | * | 12/1995 | Scott | D28/52 |
| 5,704,127 | A | * | 1/1998 | Cordio | 30/526 |
| 5,911,480 | A | | 6/1999 | Morgan | |
| 6,094,820 | A | * | 8/2000 | Adachi | 30/63 |
| 6,189,222 | B1 | | 2/2001 | Doyle | |
| 6,249,973 | B1 | * | 6/2001 | Hirano | 30/54 |
| 6,266,888 | B1 | * | 7/2001 | Zowaski | 30/526 |
| 6,581,290 | B1 | * | 6/2003 | Fishel | 30/50 |
| 6,722,039 | B2 | * | 4/2004 | Kitano | 30/30 |
| 7,028,407 | B2 | * | 4/2006 | Ehrlich et al. | 30/526 |
| 7,316,045 | B2 | | 1/2008 | Koke | |
| 7,322,108 | B2 | * | 1/2008 | Caldwell | 30/50 |
| 7,926,183 | B2 | * | 4/2011 | Groh | 30/30 |
| 8,209,869 | B2 | * | 7/2012 | Royle | 30/50 |
| 2003/0014871 | A1 | * | 1/2003 | Coffin | 30/532 |
| 2003/0177648 | A1 | * | 9/2003 | Zeiter | 30/526 |
| 2004/0107585 | A1 | | 6/2004 | Helmrich | |
| 2004/0177518 | A1 | * | 9/2004 | Leventhal | 30/526 |
| 2006/0101655 | A1 | | 5/2006 | Givant | |
| 2006/0130334 | A1 | * | 6/2006 | Park | 30/30 |
| 2006/0143926 | A1 | * | 7/2006 | Khubani et al. | 30/53 |
| 2007/0227015 | A1 | * | 10/2007 | Collins | 30/526 |
| 2009/0032043 | A1 | * | 2/2009 | Gaugler | 30/30 |
| 2009/0100679 | A1 | * | 4/2009 | Casciaro et al. | 30/526 |
| 2010/0058595 | A1 | * | 3/2010 | Walker et al. | 30/77 |
| 2011/0094108 | A1 | * | 4/2011 | Wain | 30/77 |
| 2011/0167639 | A1 | * | 7/2011 | Lau | 30/50 |
| 2012/0192427 | A1 | * | 8/2012 | Hazard | 30/30 |
| 2012/0192431 | A9 | * | 8/2012 | Wain | 30/50 |

OTHER PUBLICATIONS

Mangroomer from www.amazon.com/MANGROOMER downloaded Jun. 25, 2008.

Razorba from www.razorba.com downloaded Jun. 24, 2008.

* cited by examiner

BACK HAIR REMOVAL USING COMB AND INTEGRATED BLADE

BACKGROUND OF THE INVENTION

The present invention generally relates to apparatus and methods for removal of back hair and, more particularly, to such apparatus and methods that allow a man to remove hair from the back, shoulder and arms without a blade touching the skin.

For cosmetic reasons, men may wish to remove hair from the back, shoulders and arms. The difficulty is that these parts of the body are not easily visible. Furthermore, skin irritation caused by cutting hair is commonplace. Devices in the prior art for reaching these areas with a blade are not entirely satisfactory since shaving with a blade must be done with care and is often painful at times. In addition, this often requires the use of a three way mirror which is awkward and time consuming.

As can be seen, there is a need for a method or apparatus to remove hair, especially men's hair, from the back, shoulder and arms easily and without pain or irritation.

SUMMARY OF THE PRESENT INVENTION

In one aspect of the present invention, there is presented a hair removal device, comprising a comb having teeth on a lower end and a blade embedded in the teeth so that a lower active edge of the blade does not reach a lower edge of the teeth, the comb having an upper end; a rigid or semi-rigid one-piece elongated handle, a proximal end of the handle having a channel shaped to slidably receive the upper end of the comb, the proximal end also having a lever pressing against the comb to hold the comb securely to the proximal end of the handle, the lever capable of being bent to release the comb.

In another aspect of the invention, there is presented a method of removing hair on hard to reach areas of a skin of a person, comprising inserting a removable comb into a proximal end of a handle by actuating a release mechanism at the proximal end, the comb having embedded therein a blade that is between set off from the lower edge of the comb; holding a distal end of the handle and extending the handle so that the lower edge of the comb is flush against a skin of a user's back, shoulders and/or arms; and gliding the device over areas of the skin in which hair protrudes so as to remove hair without the blade touching the skin.

In a further aspect of the present invention, there is presented a method of removing hair on hard to reach areas of a skin of a person, comprising holding a handle having a proximal end and a distal end, the proximal end having received a removable comb, the comb having embedded therein a blade that is between approximately 0.01 and approximately 0.05 of an inch from the lower edge of the comb; extending a proximal end of the handle so that the lower edge of the comb is flush against skin of a user's back, shoulders and/or arms; and gliding the device over areas of the skin in which hair protrudes so as to remove hair while leaving at least a slight portion of the hair above a surface of the skin.

These and other features, aspects and advantages of the present invention will become better understood with reference to the following drawings, descriptions and claims.

DETAILED DESCRIPTION OF THE INVENTION

Figure 1:
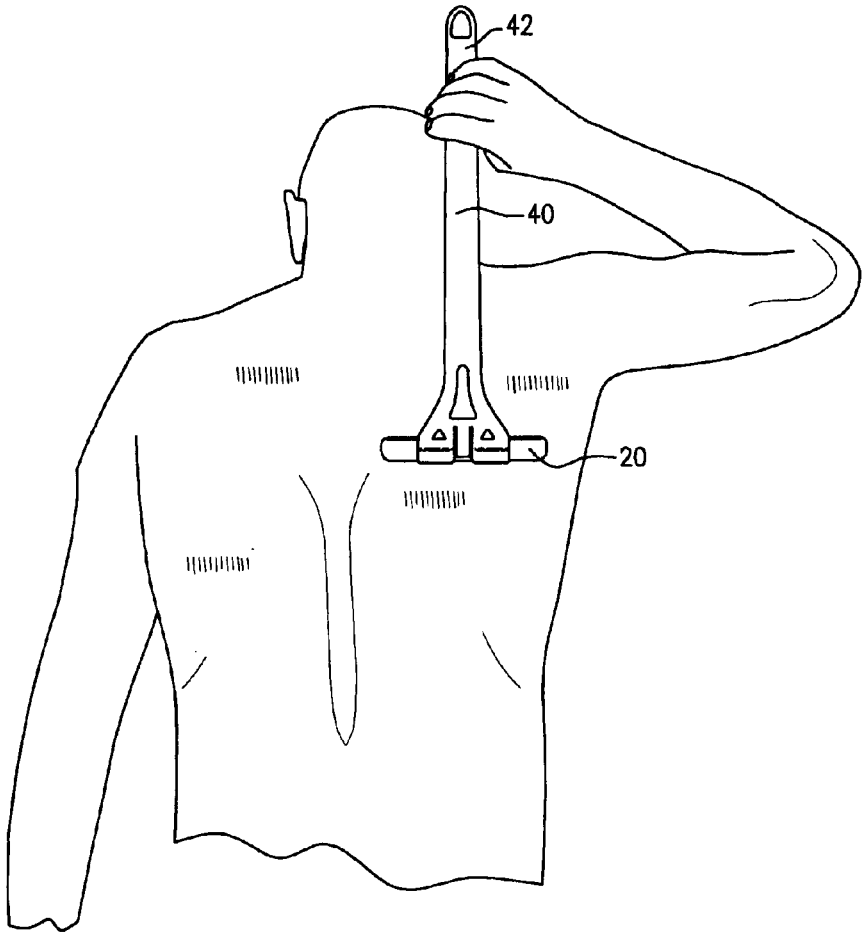
FIG. 1 is a perspective view of the apparatus of the present invention being applied to a man's back for hair removal.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a device for easy removal of hair on the back, shoulders and arms of a man. The hair is not removed below skin surface and a small amount of the length of the hair remains since the blade is displaced from the edge of the teeth of the comb by approximately one thirtieth of an inch.

In contrast to the prior art, in which hair removal causes skin irritation, nicks, rashes and cuts due to the blade of the device being exposed and applied directly to the skin and in which use may cause later irritation during skin regrowth because the blade cuts the full length of the hair and even below the surface of the skin, the device of the present invention may be able to achieve not causing any pain, discomfort or skin irritation, cuts or nicks. In further contrast to the prior art, in which the devices employ blades that are exposed and which are not safe particularly when using the device in areas of the skin that are not visible, the device of the present invention may utilize a blade that is not exposed. In contrast to the prior art, in which the handle or other part of the device may contain multiple parts and elements with multiple connecting points, the device of the present invention may be comprised of an easy to manufacture one-piece integrally molded handle that may hold a disposable blade compartment. In further contrast to the prior art, in which a device for hair removal may not be specifically tailored and conveniently applied for use on hard to reach and hard to see areas of the skin on the lower and upper back, shoulders and arms, the device of the present invention may be designed to conveniently and easily remove hair on these areas. In still further contrast to the prior art, in which hair removal may have no incidental enjoyable effects, the hair removal method of the present invention may generate a very pleasant and smooth sensation and even an enjoyable buzzing sound. In further contrast to the prior art in which hair removal from unseen areas requires awkward use of mirrors or the use of straining movements to ensure the head is in constant contact with the back, shoulder or arms, the method and apparatus of the present invention may not require use of a mirror and may not involve unusually straining movements. One reason for the fact that such straining movements are unnecessary is that the center of gravity may be located approximately ⅓ down the length of the handle starting from the proximal end of the handle. In still further contrast to the prior art, which may be comprised of multiple parts, the device of the present invention may be made essentially of only a handle and a removable (and disposable) comb, the comb having its blade embedded therein. In further contrast to the prior art, in which replacement of the blade cannot be detected other than by sight, the device of the present invention may let the user know when the comb needs replacing through the sound it makes (besides through visual inspection). For example, when the normal pleasant sound that the device makes, which sounds like a pleasant scraping, dims or becomes less frequent, it may be time to replace the comb.

Figure 2:
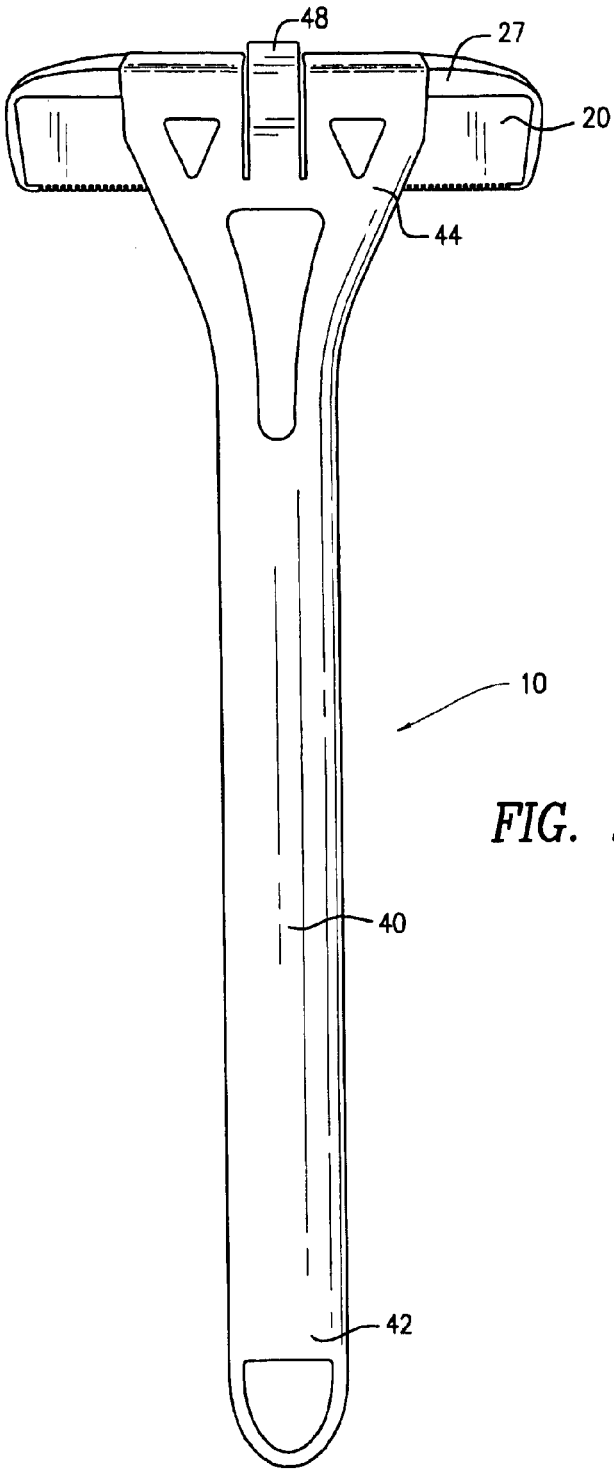
FIG. 2 is a rear view of the apparatus for hair removal, in accordance with the present invention.

As seen from FIG. 2, there is shown a hair removal device 10 comprising a comb 20 having teeth 29 that are located on a lower end 24 of the comb 20. As seen from FIG. 6, a blade 30 having a cutting edge 33 for cutting hair is immediately adjacent to teeth 29 so that the cutting edge 33 of blade 30 does not extend far enough to reach a lower edge a lower edge 29*a* of teeth 29. The distance that blade 30 may be set off from the lower edge 29*a* of teeth 29 of comb 20 may vary and in one embodiment may be between approximately 0.02 and approximately 0.05 of an inch. Blade 30 may vary in thickness but in a preferred embodiment may be approximately 0.004 inches thick. Comb 20 has an upper end 26. As seen from FIG. 5, upper end 26 or a portion thereof may be shaped to operatively engage handle 40.

When device 10 is in use, these teeth 29 may make actual contact with the skin of the user. Accordingly, teeth 29 may be rounded or otherwise shaped to create a comfortable feeling upon being glided or dragged along the skin in the area of a back, shoulder or arms of a user. Typically, such a user would be a man.

Figure 3:
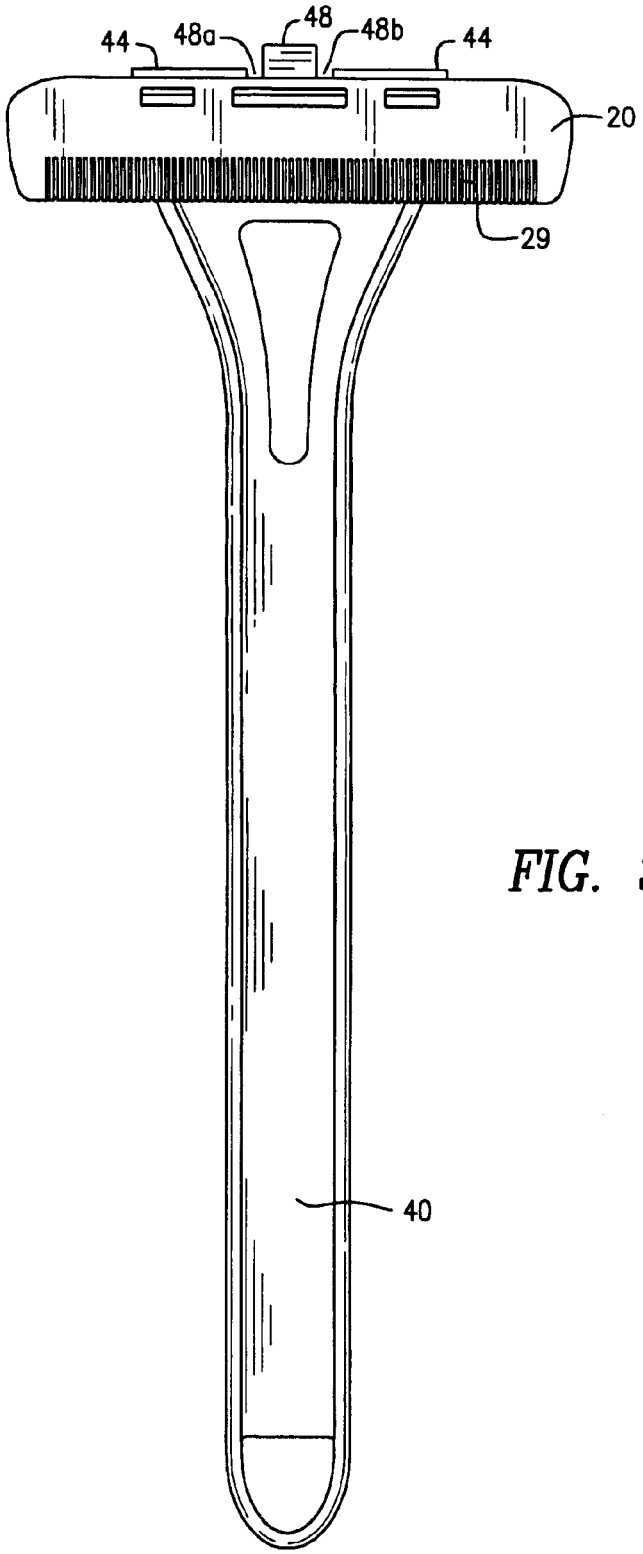
FIG. 3 is a front view of the apparatus of the present invention.
Figure 4:
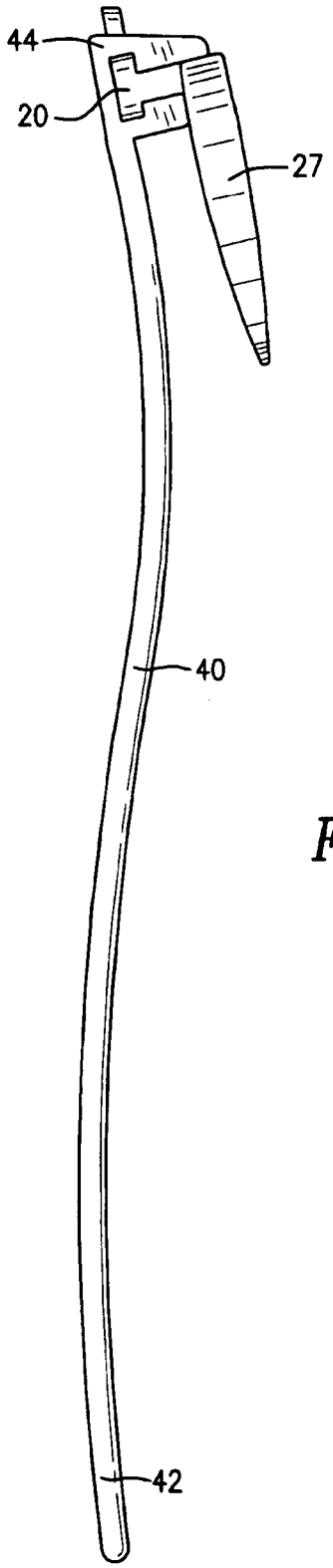
FIG. 4 is a side elevational view of the apparatus of the present invention, the other side elevational view of this embodiment of the present invention being identical.

As seen from FIG. 3, device 10 may also comprise a generally rigid one-piece elongated handle 40 having a distal end 42 where, as seen from FIG. 1, a user would typically grasp handle 40 as well as a proximal end 44, so called because proximal end 44 is proximate to a user's skin and hair. Alternatively, handle 40 may be semi-rigid but its rigidity should be sufficient to not only maintain its shape through constant use but also ensure the safety of device 10. Handle 40 may be curved as shown in FIG. 4, or may be straight, when viewed from the side. In addition, as seen from FIG. 2, FIG. 3 and FIG. 4, handle 40 may be of simple construction and may be lightweight. In a preferred embodiment, handle 40 may be made of a single piece, for example of plastic. Handle 40 need not be articulated and need not have any joints, hinges, gears or interlocking points along its length causing handle 40 to pivot or bend. One purely illustrative manner of manufacturing handle of device 10 would be from a plastic mold.

Although device 10 may not be especially heavy, device 10 may have a center of gravity located approximately ⅓ of the way down the length of the handle 40 as measured going from the proximal end 44 of handle 40 (near comb 20) to its distal end 42. This may be accomplished in a variety of ways, including by thickening the housing 27 of comb 20 relative to the handle 40. The location of the center of gravity at approximately ⅓ the length of the handle 40 may assist in ensuring that the comb 20 may be in constant contact with the back, shoulders or arm. Thus comb 20 may rest naturally rests against the skin of the user from the upward and downward motion of device 10 rather than having to be awkwardly pressed against the skin.

Figure 7:
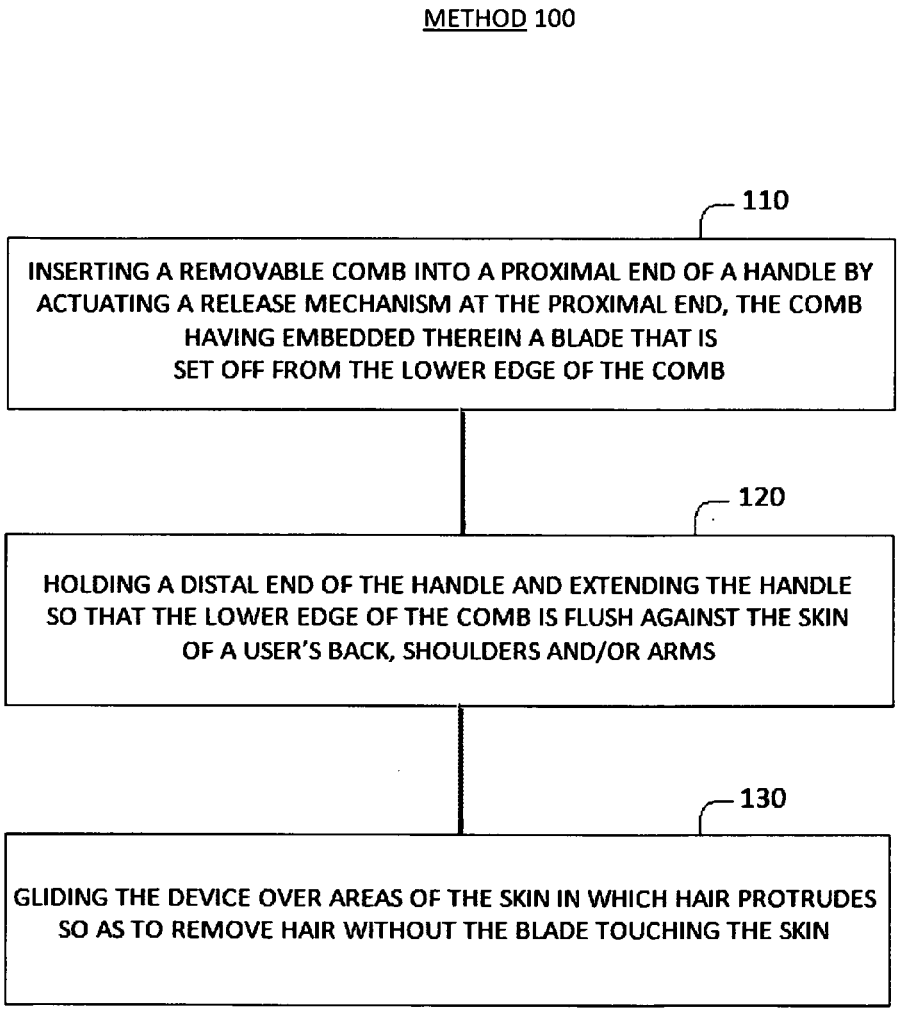
FIG. 7 is a flow chart showing a method of the present invention.

As noted, comb 20 may have an upper end 26 and this upper end 26 is shaped to fit securely in handle 40. In particular, as seen from FIG. 5, proximal end 44 of handle 40 has a channel 46 shaped to slidably a projecting portion 26*a* of upper end 26. Proximal end 44 of handle 40 may have a lever 48 that may be integrally molded to the rest of handle 40. As seen in FIG. 3 and FIG. 7, lever 48 may have spaces 48*a*, 48*b* (see FIG. 7) on a left and right side thereof so as to facilitate the flexibility of lever 48. Accordingly, when comb 20 is inserted into handle 40, lever 48 of handle 40 is naturally urged to press against projecting portion 26*a* of comb 20. This serves to hold comb 20 securely to the proximal end 44 of handle 40. Although lever 48 is naturally urged to press against comb 20, lever 48 may be easily bent away from the housing 27 of comb 20 thereby effectuating the release of comb 20. Accordingly, comb 20 may be removable with one easy motion, i.e. bending lever 48 of handle 40.

Figure 5:
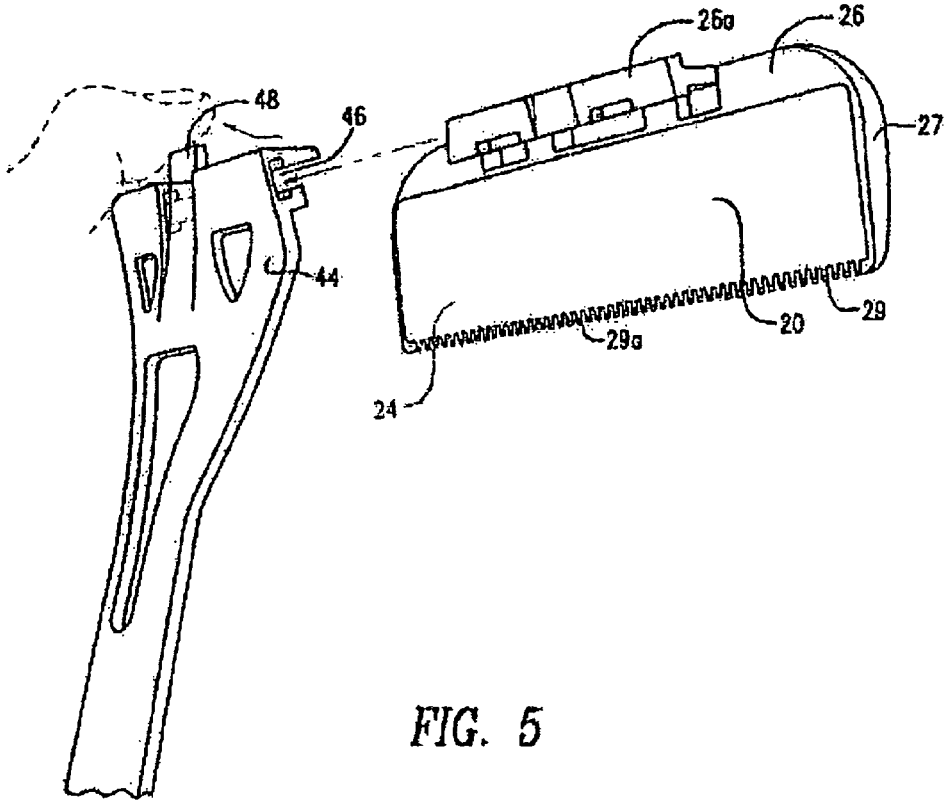
FIG. 5 is an exploded view of the apparatus of the present invention that depicts in phantom a user's finger actuating the release mechanism for removal of the blade.

It should be understood that while FIG. 5 depicts a particular shape of the projecting portion 26*a* of the upper end 26 of comb 20 so as to slide into the channel 46 in the proximal end 44 of handle 40, the actual shape of the projecting portion 26*a* may vary considerably. Accordingly, the actual shape of the space or channel 46 in handle 40 may also vary. Furthermore, in certain embodiments, comb 20 may attach to proximal end 44 of handle 40 through means other than sliding into a channel or space. For example, comb 20 may be clamped on to proximal end 44 of handle 40.

Although the recommended replacement of comb 20 may be after approximately ten uses, it may actually be possible to hear when the normal pleasant scraping sound becomes dim or less frequent. In addition, it may be possible to see when the blade 30 of device 10 becomes dull. As can be seen from FIG. 5, which shows a hand in phantom lines, comb 20 may be replaced with a different comb 20 by simply bending lever 48 to release handle 40 from comb 20 and similarly by inserting a different comb while again bending lever 48 backward.

As seen from FIG. 3, when the projecting portion 26*a* of comb 20 is in place in the channel 46 of the handle 40, comb 20 and blade 30 are substantially parallel to a length of handle 40. Although this is the preferred embodiment, other configurations may be possible.

Figure 6:
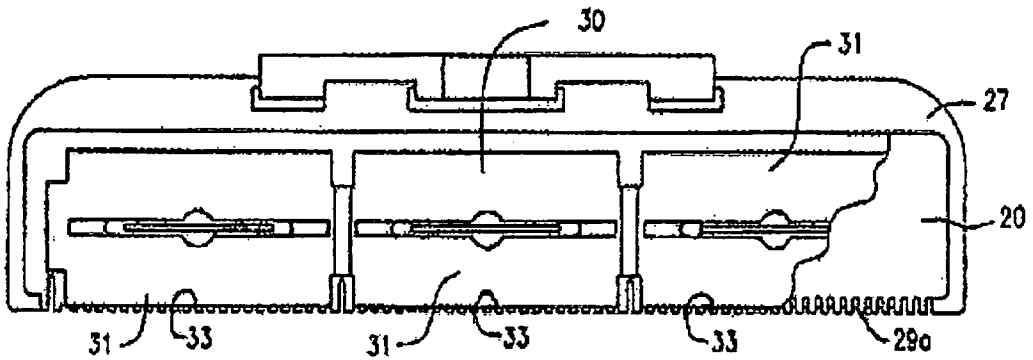
FIG. 6 is a plan view of the comb 20 used in the apparatus of the present invention with the housing 27 of the comb partially broken away.

As seen from FIG. 6, blade 30 may be comprised of several blade portions 31 that together make up blade 30. For example, blade 30 may have at least two blade portions. In that case, the at least two blade portions may have equal dimensions and may have edges that extend the same distance from the lower edge of the teeth 29 of comb 20. As shown in FIG. 6, blade 30 may be comprised of three blade portions 31 arranged in series. Although the length of each blade portion 31 may vary, in one embodiment, each blade portion 31 may be approximately one and three quarters inches long and approximately seven-eighths of an inch wide. Blade portions 31 need not all be of equal length and theoretically need not even be of equal width. However, blade portions 31 may all terminate at the same distance or approximate distance from the lower edge of teeth 29 of comb 20.

FIG. 1 depicts handle 40 as being long enough that comb 20 may reach the back of the user holding distal end 42 of handle 40. It should be understood that FIG. 1 is merely illustrative and in fact, handle 40 of device 10 may be long enough so that when the user grasps distal end 42 of handle 40, hair on the lower back may be removed.

As seen from FIG. 7, the present invention can also be viewed as a method 100 of removing hair on hard to reach areas of a skin of a person. Method 100 may comprise a first step 110 of inserting a removable comb into a proximal end of a handle by actuating a release mechanism at the proximal end. The inserting may be achieved simply by slightly bending a lever integrally molded to the handle and inserting the comb into a channel in the proximal end of the handle. As with the apparatus of the present invention, the comb used in method 100 of the present invention may have embedded therein a blade that may be set off between approximately 0.02 and approximately 0.05 of an inch from the lower edge of the comb and preferably approximately 0.033 inches from the lower edge of the comb. Method 100 may also include a step 120 of holding a distal end of the handle and extending the handle so that the lower edge of the comb is flush against skin of a user's back, shoulders and/or arms. Further, method 100 may include step 130 of applying the device 10 on the skin by gliding the device over areas of the skin in which hair protrudes so as to remove hair without the blade touching the skin.

Figure 8:
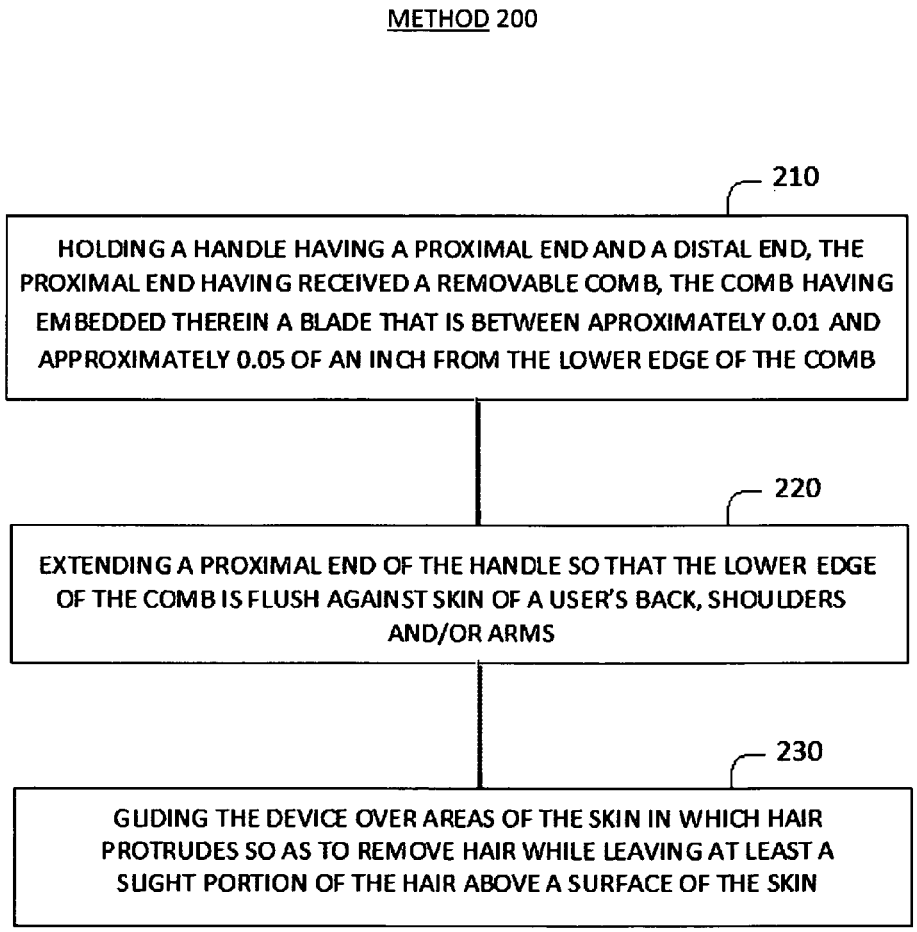
FIG. 8 is a flow chart showing a method of the present invention.

As seen from FIG. 8, the present invention can also be viewed as a method 200 of removing hair on hard to reach areas of a skin of a person. Method 200 may include step 210 of holding a handle having a proximal and a distal end, the proximal end having received a removable comb, the comb having embedded therein a blade that may be between approximately 0.01 and approximately 0.05 of an inch from the lower edge of the comb. Method 200 may also include step 220 of extending a proximal end of the handle so that the lower edge of the comb is flush against skin of a user's back, shoulders and/or arms and a step 230 of gliding the device over areas of the skin in which hair protrudes so as to remove hair while leaving at least a slight portion of the hair above a surface of the skin.

In methods 100 and 200, the teeth of the comb may massage the skin gently during removal of the hair since the teeth may have rounded ends. Furthermore, in methods 100, 200 the teeth of the comb may generate a light buzzing sound when it glides across the skin during removal of the hair.

Although the first time that the device of the present invention is used in accordance with the method of the present invention, the process of hair removal may be expected to take 15-25 minutes, subsequent uses may be expected to have durations of only five to ten minutes. The frequency of use varies with the user but typically once or twice a week is all that may be necessary.

It should be understood, of course, that the foregoing relates to exemplary embodiments of the invention and that modifications may be made without departing from the spirit and scope of the invention as set forth in the following claims.

We claim:

1. A hair removal device comprising:

at least one blade with a cutting edge;

an elongate handle having an upper end, a bottom end, and a longitudinal axis, the upper end defining a channel extending substantially perpendicular to the longitudinal axis and a flexible lever movable from a rest position where the lever is in the channel and a flexed position where the lever is moved outside of the channel;

a comb having a body and a projection, the body having an upper portion, a bottom edge defining a plurality of teeth, a blade holding portion, and a skin engaging surface opposite the blade holding portion;

wherein the plurality of teeth are in communication with the blade holding portion and the skin engaging surface;

wherein the projection is attached to the upper portion and extends perpendicular to the body;

wherein the blade holding portion is configured to hold the at least one blade in a position where the cutting edge is immediately adjacent to the plurality of teeth and where the plurality of teeth extend a distance beyond the cutting edge of the at least one blade;

the projection of the comb is received in the channel of the handle wherein the lever abuts the projection when the lever is in the rest position and is spaced from the projection when the lever is in the flexed position; and wherein the at least one blade is in-between the body of the comb and the handle and the skin engaging portion and the plurality of teeth engage a user during use.

2. The hair removal device of claim 1, wherein the handle is one-piece.

3. The hair removal device of claim 1, wherein the handle is rigid or semi-rigid plastic.

4. The hair removal device of claim 1, wherein the at least one blade is at least two blades each with cutting edges.

5. The hair removal device of claim 1, wherein the at least one blade is three blades each with cutting edges.

6. The hair removal device of claim 1, wherein each of the plurality of teeth are rounded.

7. The hair removal device of claim 1, wherein a distance the plurality of teeth extend beyond the cutting edge is between approximately 0.02 inches and approximately 0.05 inches.

8. The hair removal device of claim 7, wherein the distance the plurality of teeth extend beyond the cutting edge is approximately 0.033 inches.

9. The hair removal device of claim 1, wherein the at least one blade is approximately 0.004 inches in thickness.

10. The hair removal device of claim 1, wherein the handle is curved.

11. The hair removal device of claim 1, wherein when the projection of the comb is received in the channel, the body and the at least one blade are both substantially parallel to at least a portion of the handle.

* * * * *